US006755685B1

(12) United States Patent
Espenshade

(10) Patent No.: US 6,755,685 B1
(45) Date of Patent: Jun. 29, 2004

(54) ELECTRICAL CONNECTOR WITH IMPROVED CONTACTS

(75) Inventor: Leonard K. Espenshade, Harrisburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/672,148

(22) Filed: Sep. 25, 2003

(51) Int. Cl.[7] ..... H01R 13/60
(52) U.S. Cl. ..... 439/541.5
(58) Field of Search ..... 439/541.5, 676, 439/76.1, 607, 609

(56) References Cited

U.S. PATENT DOCUMENTS 6,162,089 A 12/2000 Costello et al.
6,183,292 B1 * 2/2001 Chen et al. ..... 439/541.5
6,402,564 B1 6/2002 Shi et al.
6,478,610 B1 * 11/2002 Zhou et al. ..... 439/490
6,685,505 B1 * 2/2004 Espenshade et al. ..... 439/541.5
6,688,909 B1 * 2/2004 Espenshade et al. ..... 439/490
6,688,914 B1 * 2/2004 Espenshade et al. ..... 439/541.5

* cited by examiner

*Primary Examiner*—Gary Paumen
(74) *Attorney, Agent, or Firm*—Wei Te Chung

(57) ABSTRACT

An electrical connector (100) mounted on a main printed circuit board (PCB), includes an insulative housing (1) having a front mating face providing a receiving cavity (111) extending rearwardly thereinto. A number of ramps (115) raised from a bottom portion of the receiving cavity, thereby forming a number of slots (114) positioned between the adjacent ramps. A number of conductive contacts (2) exposed in the receiving cavity. Each contact includes a base portion (21) having a front nose (211) in a front portion thereof, a contacting portion (22) angled rearwardly from the front nose and a pair shoulder (212) extending transversely from opposite sides of the base portion adjacent to the front nose. The base portions of the contacts are held in the corresponding slots. The shoulders are engaged and latched with the raised ramps.

2 Claims, 10 Drawing Sheets

ELECTRICAL CONNECTOR WITH IMPROVED CONTACTS

CROSS-REFERENCE TO RELATED APPLICATION

This application is related to a contemporaneously filed U.S. patent application entitled "ELECTRICAL CONNECTOR WITH IMPROVED FOOTER CONTACTS" with the same applicant and assigned to the common assignee.

BACKGROUND OF THE INVENTION

1. Field of the Invention

The present invention relates to an electrical connector and more particularly, to an electrical connector being mounted onto a circuit board.

2. Description of the Prior Art

A computer is required to provide connectors at input/output ports which are usually mounted on a main printed circuit board (PCB) thereof, to mate with complementary connectors of external devices for signal transmission therebetween. In order to sufficiently utilize limited area of the main PCB, the electrical connectors are usually arranged in a stacked manner.

U.S. Pat. No. 6,162,089 discloses a stacked connector assembly. The conventionally connector assembly has a pair of USB plug-receiving cavities stacked beneath a modular plug-receiving cavity. Modular contacts are disposed in the modular plug-receiving cavity and are insert-molded in a horizontal front and a vertical rear insert, wherein the rear insert functions as a fixing device. The front and the rear inserts are molded around the modular contacts before severing carrier strips from opposite ends of the modular contacts. Front contacting portions of the modular contacts are angled upwardly and rearwardly relative to the horizontal front insert. The rear insert is downwardly bent to be formed at a right angle with respect to the front insert, in which rear right-angle tail portions of the modular contacts are embedded. Thereafter, the front and the rear inserts with the terminals retained therein are assembled to the housing. The contacting portions of the modular contacts are received in the modular plug-receiving cavity. The rear insert is fixed on the housing. Thus, the right-angle tail portions of the modular contacts are retained in the housing by the rear insert.

However, the modular contacts are assembled to the housing after being insert molded with plastic material, thus increasing the processes of manufacturing the front and the rear inserts. Due to inherent factors, such as relative larger sizes of the front and the rear inserts, the modular contacts need to occupy relative larger available space in the conventional connector assembly such that whole dimension of the connector assembly are maximized. On the other hand, because the front and the rear inserts are integrally molded with the terminals, the front and the rear inserts cannot be reused and it will increase the cost.

Hence, an electrical connector with improved contacts is desired.

SUMMARY OF THE INVENTION

An object of the present invention is to provide an improved electrical connector, which can conveniently and securely retaining contacts in an insulative housing thereof.

An electrical connector mounted on a main printed circuit board (PCB), includes an insulative housing having a front mating face providing a receiving cavity extending rearwardly thereinto. A number of ramps raised from a bottom portion of the receiving cavity, thereby forming a number of slots positioned between the adjacent ramps. A number of conductive contacts exposed in the receiving cavity. Each contact includes a base portion having a front nose in a front portion thereof, a contacting portion angled rearwardly from the front nose and a pair shoulder extending transversely from opposite sides of the base portion adjacent to the front nose. The base portions of the contacts are held in the corresponding slots and the shoulders are engaged and latched with the raised ramps.

Other objects, advantages and novel features of the invention will become more apparent from the following detailed description when taken in conjunction with the accompanying drawings.

DETAILED DESCRIPTION OF THE INVENTION

Figure 1:
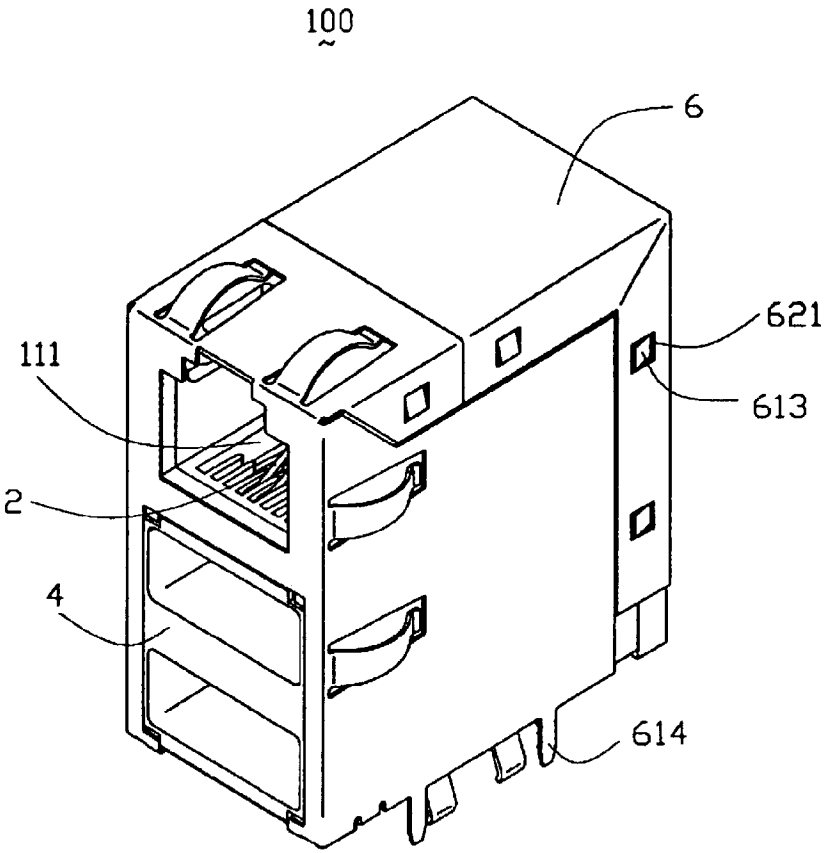
FIG. 1 is a perspective view of an electrical connector according to the present invention.
Figure 2:
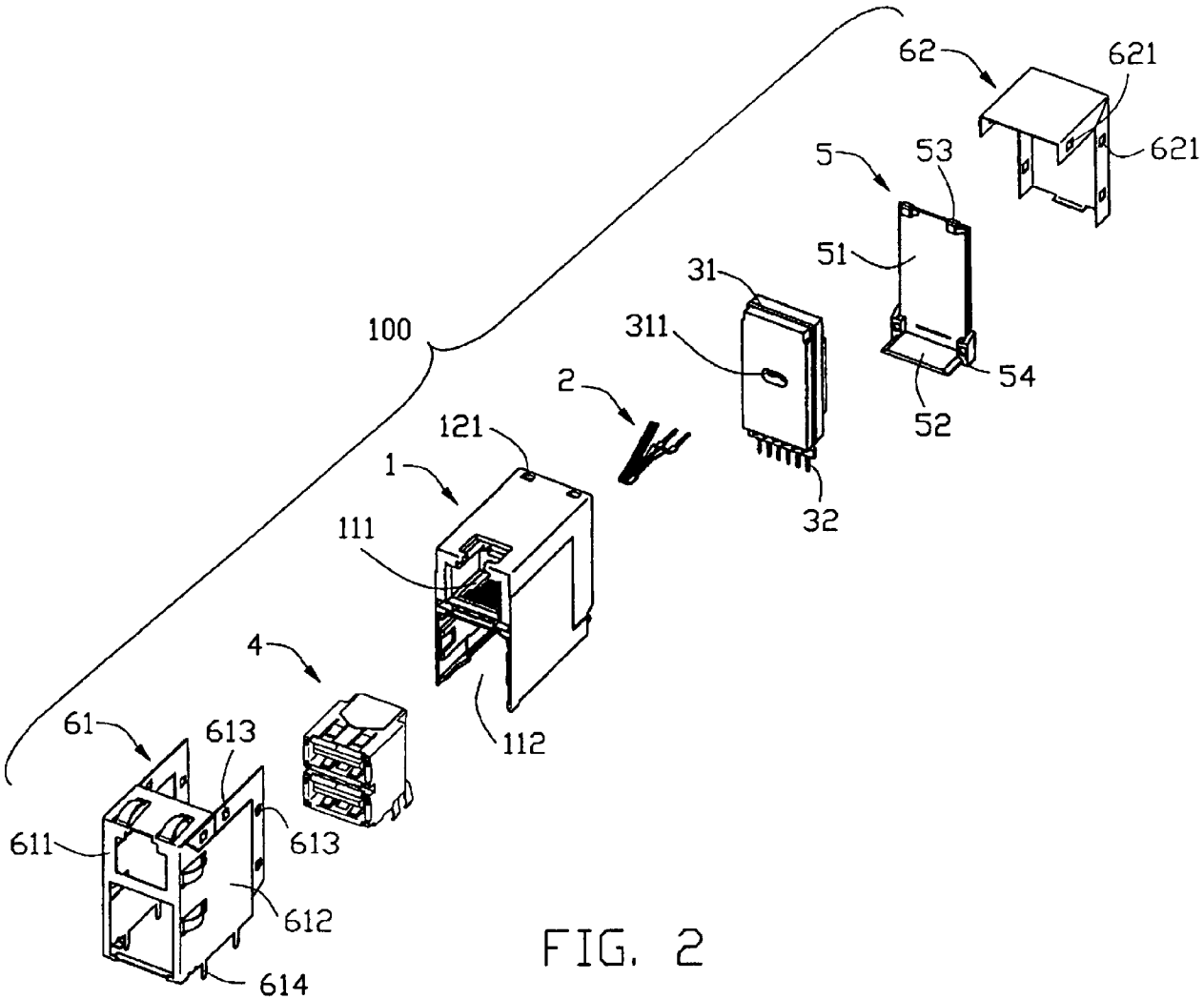
FIG. 2 is an exploded view of FIG. 1.
Figure 3:
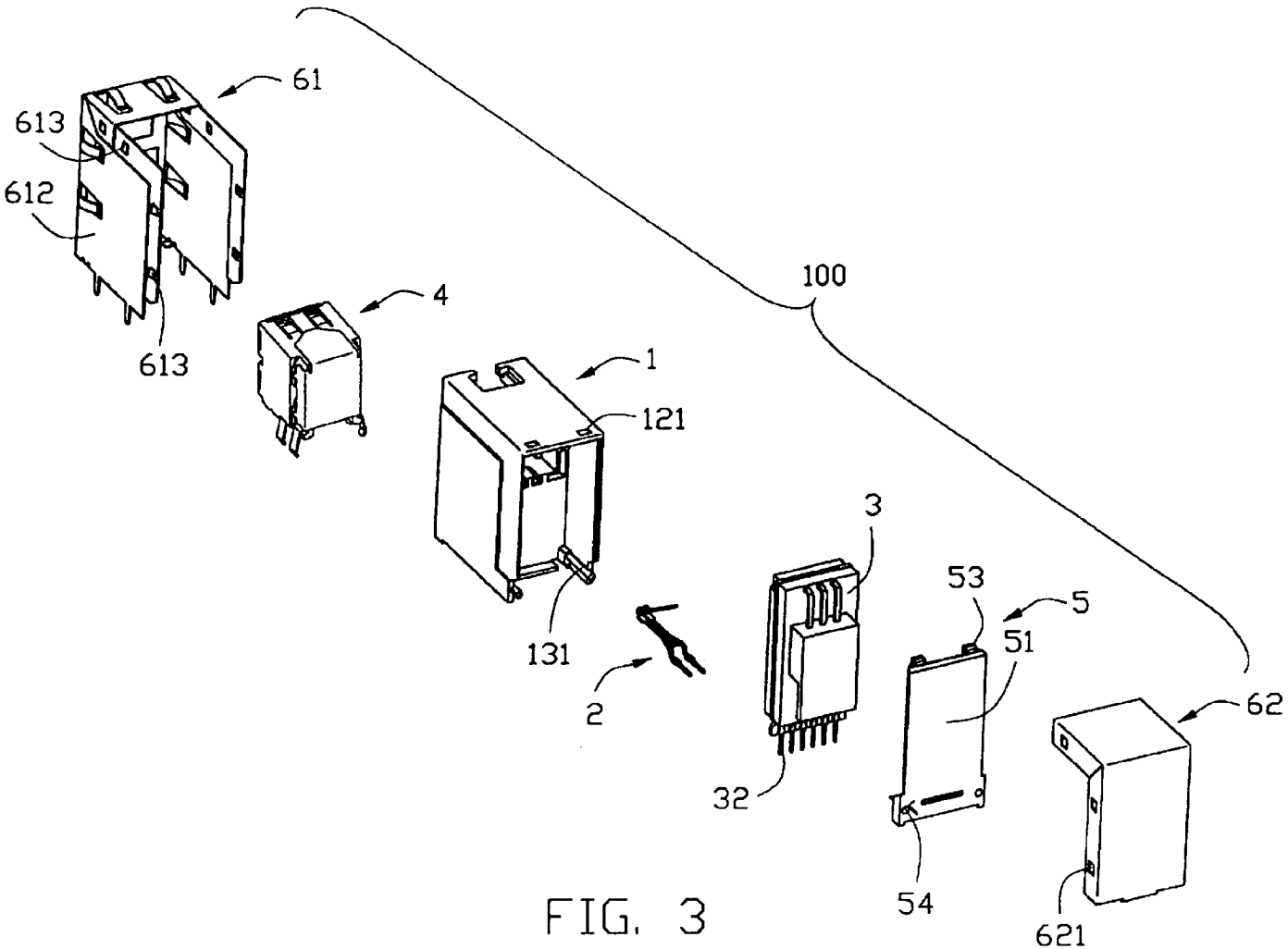
FIG. 3 is another exploded view of FIG. 1.

Referring to FIGS. 1, 2 and 3, an electrical connector 100 mounted on a main printed circuit board (PCB, not shown) is preferably a multi-port modular jack, and includes an insulative housing 1, a plurality of conductive contacts 2 retained in the housing 1, an insert module 3, a connector module 4 (shown in FIG. 2), a plastic rear cover 5 and an outer shell 6 substantially surrounding and shielding the housing 1.

Figure 4:
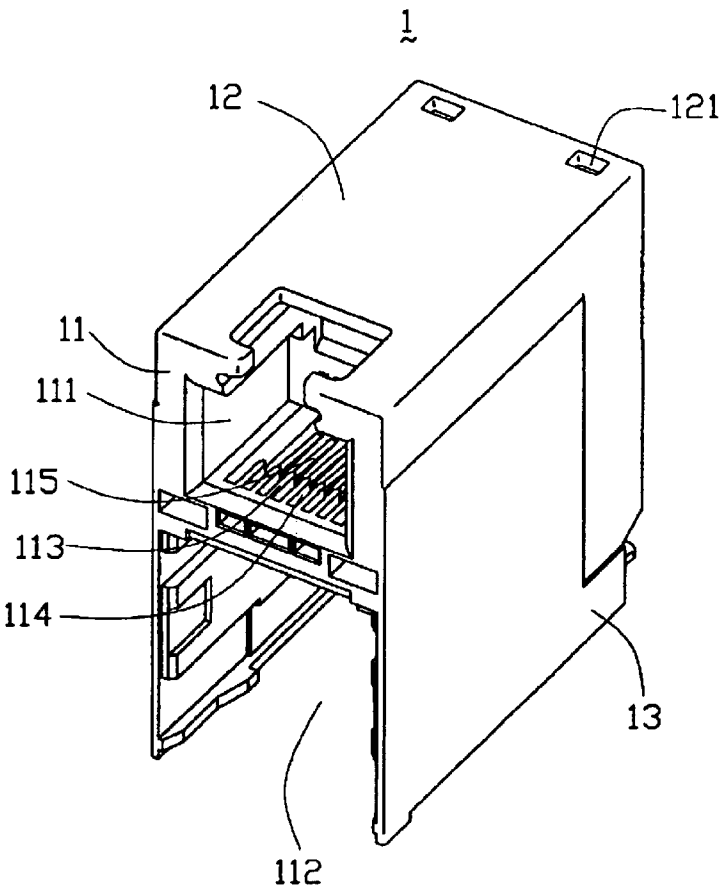
FIG. 4 is a perspective view of an insulative housing of the electrical connector.
Figure 5:
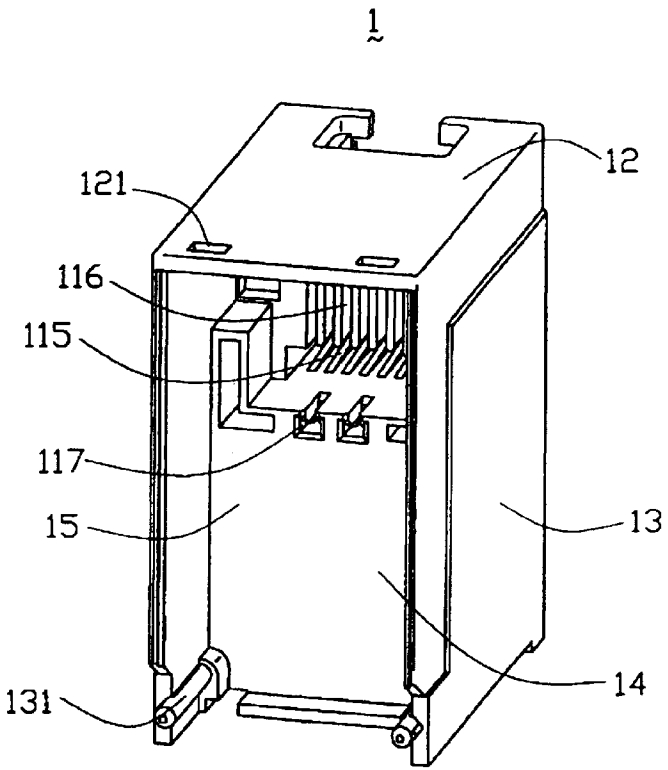
FIG. 5 is another perspective view of FIG. 4.

Referring to FIGS. 4 and 5, the insulative housing 1 includes a mating face 11, an upper wall 12, two sidewalls 13 and a rear opening 14. The mating face 11 provides an upper and a lower cavities 111, 112 extending rearwardly thereinto. The rear opening 14 shares a panel 15 with the lower cavity 112. In the embodiment illustrated, the upper cavity 111 is a modular plug-receiving cavity for mating with a modular plug connector, and the lower cavity 112 is provided for receipt thereinto of the connector module 4. The upper cavity 112 provides a plurality of barriers 113 projecting inwardly from the mating face 11, and a number of ramps 115 essentially aligned with and spaced from corresponding barriers 113 in a longitudinal direction, thereby forming a plurality of parallel slots 114 between the adjacent barriers 113 and the ramps 115 in a front-to-rear direction for receiving corresponding contacts 2. A plurality of grooves 117 are dimensioned to be positioned proximate the panel 15 and communicating with the rear opening 14 for receiving the contacts 2. The housing 1 further includes a plurality of comb passages 116 extending into the upper cavity 111 and communicating with the rear opening 14. The upper wall 12 defines a pair of locking holes 121 far from the mating face 11. Each sidewall 13 has a shaft 131 projecting inwardly from a bottom portion thereof for engaging with the plastic rear cover 5.

Figure 6:
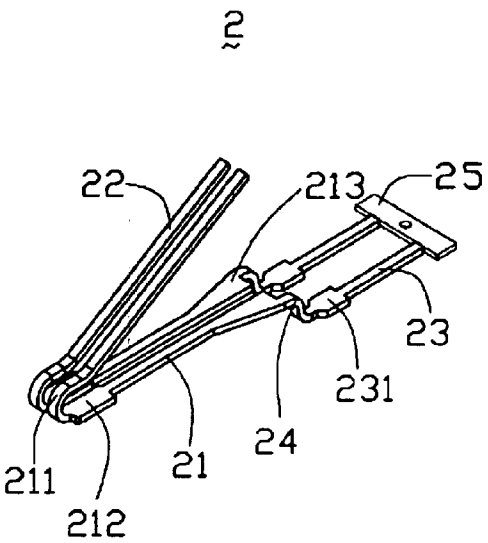
FIG. 6 is a perspective view of conductive contacts attached to a carrier strip of the electrical connector.

As best shown in FIG. 6, the conductive contacts 2 are initially attached to a carrier strip 25. Each conductive contact 2 includes a base portion 21 having a front nose 211 on a front section thereof, a contacting portion 22 upwardly and rearwardly extending from the front nose 211 of the base portion 21 and a tail portion 23 connected to the carrier strip 25. The base portion 21 has a pair of shoulders 212 adjacent to the front nose 211 and extending transversely from opposite sides thereof. The base portion 21 further has an enlarged section 213 apart from the front nose 211 and extending transversely and outwardly. The tail portion 23 is integrally attached to the enlarged section 213 by a transition bight 24. The tail portion 23 downwardly offsets from the transition bight 24 and is parallel to the base portion 21. The tail portion 23 has a positioner section 231 extending from opposite sides thereof adjacent to the transition bight 24.

Figure 9:
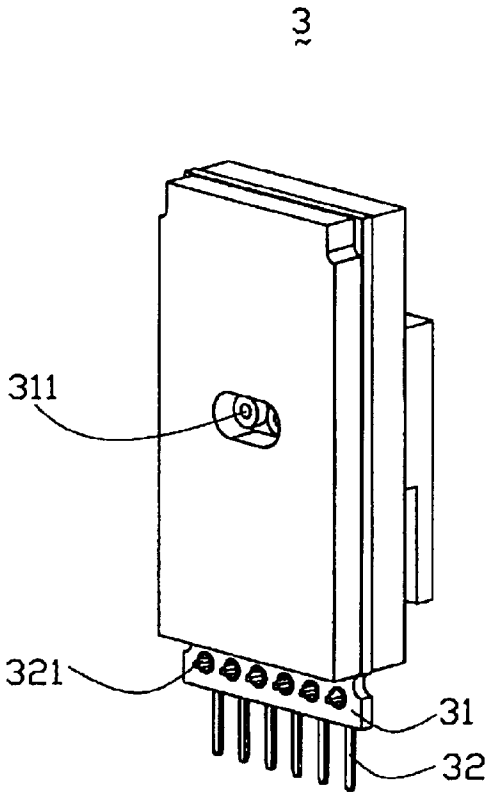
FIG. 9 is a perspective view of an insert module of the electrical connector.
Figure 10:
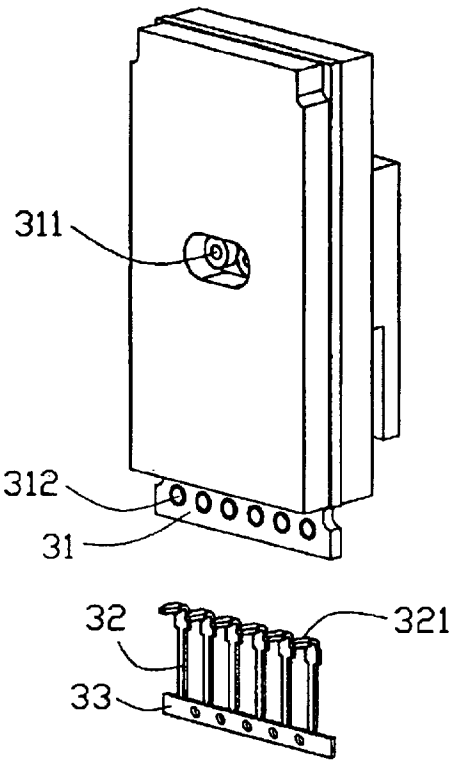
FIG. 10 is an exploded view of FIG. 9.

Referring to FIGS. 9 and 10, the insert module 3 includes an internal PCB 31 and a plurality of footer contacts 32 attached to the internal PCB 31. The internal PCB 31 provides a plurality of pinouts 311 on a substantial middle portion thereof for respectively receiving the contacts 2 and a plurality of footer holes 312. Each footer contact 32 has a latch beam 321 extending horizontally from a top portion thereof and interferentially fitted in the corresponding footer holes 312. It should be noted that the footer contacts 32 are initially-attached to a carrier strip 33. The carrier strip 33 is removed from the footer contacts after the footer contacts are installed in the internal PCB and soldering thereto.

Referring to FIGS. 2 and 3, the plastic rear cover 5 includes a vertical portion 51 and a horizontal portion 52 extending forwardly from a bottom side of the vertical portion 51. The vertical portion 51 includes a pair of projections 53 extending from a top end thereof and a pair of fixing portions 54 formed near opposite sides of a bottom end thereof. The projections 53 are provided for latching within the locking holes 121 of the housing 1, respectively. The fixing portions 54 are provided for engaging with the corresponding shafts 131 of the housing 1.

The outer shell 6 is stamped from a sheet of conductive material and includes a front shell 61 and a rear shell 62 which mount together to define an interior space for enclosing the housing 1. The front shell 61 includes a front plate 611 providing two windows (not labeled) respectively corresponding to the upper and lower cavities 111, 112, and two side plates 612. Each side plate 612 has a plurality of embossments 613 and a plurality of grounding tabs 614 extending downwardly from a bottom end thereof. The rear shell 62 has a number of apertures 621 corresponding to and engaging with respective ones of the embossments 613.

Figure 7:
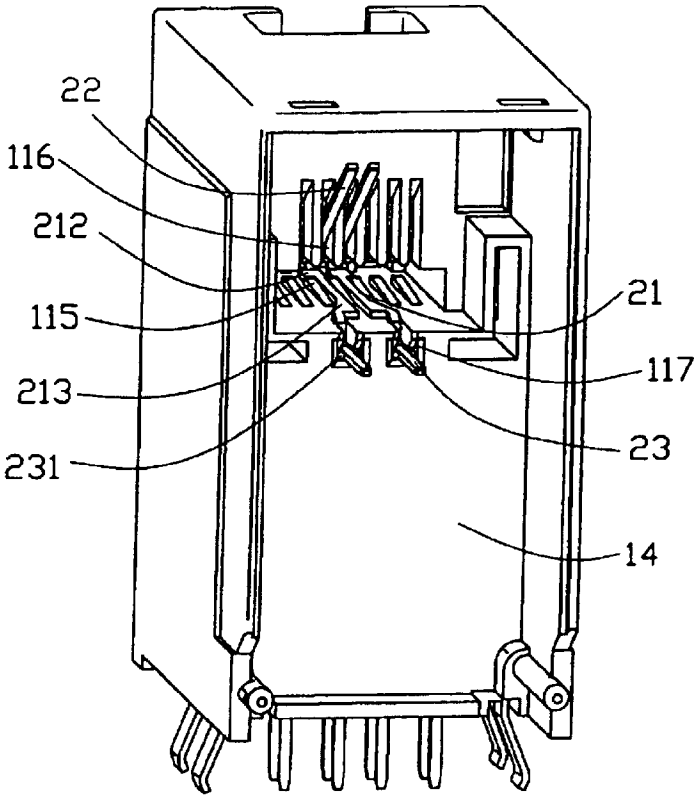
FIG. 7 is a partially assembled view of FIG. 2 showing the contacts assembled within the insulative housing taken from back aspect.
Figure 8:
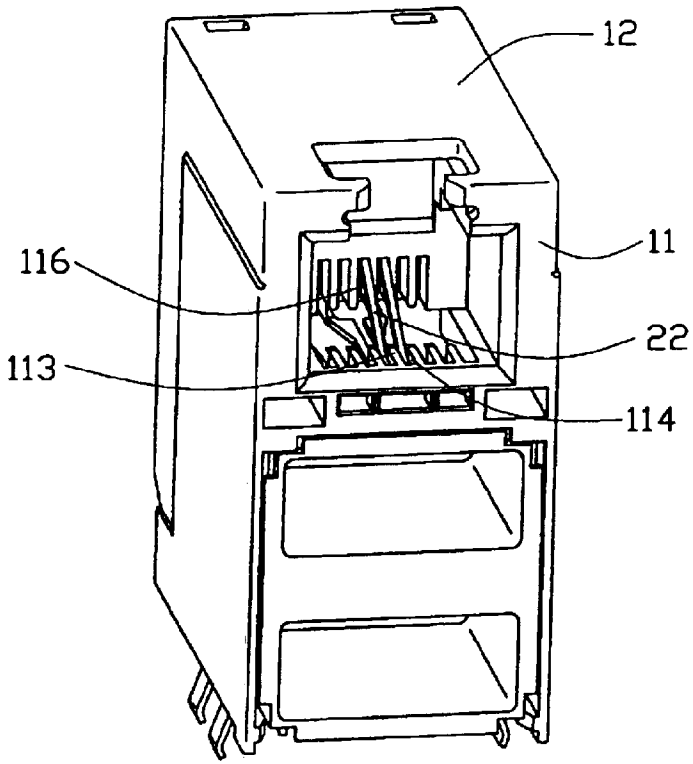
FIG. 8 is another partially assembled view of FIG. 2 showing the contacts and a connector module assembled within the insulating housing taken from front aspect.

Referring to FIGS. 7 and 8 in conjunction with FIG. 6, in assembly, the conductive contacts 2 are installed in the housing 1 from the rear opening 14. The front nose 211 of each contact 2 extends through respective one of the passages 116 and is received in the corresponding slot 114. The contacting portion 22 of each contact 2 is exposed in the upper cavity 111 with a free end deflected by the corresponding passage 116, thereby having a preload force. The base portion 21 and the front nose 211 of each contact 2 are held in the slot 114. The shoulders 212 of each contact 2 are latched with the raised ramps 115, in conjunction with the contact preload force which keeps a constant downward force on the contacts 2, thereby assuring that the contacts 2 don't lift off the shoulders at the end of the ramps. The positioner sections 231 of the contacts 2 are received in the grooves 117. Therefore, the contacts 2 are securely embedded in the housing 1. After installation, the carrier strip 25 is removed from the contacts 2.

Referring to FIGS. 2 and 3 in conjunction with FIG. 1, the insert module 3 is attached to the housing 1 from the rear opening 14. The tail portion 23 of each contact 2 extends beyond the grooves 117 and into the respective one of the pinout 311 of the internal PCB 31. The plastic rear cover 5 is coupled to the housing 1. The shafts 131 of the housing 1 are installed in the fixing portion 54 of the plastic rear cover 5. The projections 53 of the plastic rear cover 5 are received in the corresponding locking holes 121 of the housing 1, thereby stabilizing the connection between the contacts 2 and the internal PCB 31. The connector module 4 such as a dual USB module, is assembled to the lower cavity 112 of the housing 1 from the mating face 11. The structure and the function of the connector module 4 is well known to those skilled in the art, a detailed description thereof is omitted herefrom. The outer shell 6 substantially surrounds the housing 1. The front plate 611 of the front shell 61 affixes along the mating face 11 of the housing 1. The embossments 613 are interference fitted in the respective one of the apertures 621. The grounding tabs 614 are soldered to the corresponding grounding holes (not shown) of the main PCB.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the fill extent indicated by the broad general meaning of the terms in which the appended claims are expressed.

What is claimed is:

1. An electrical connector for being mounted on a main printed circuit board, comprising:

an insulative housing having a front mating face providing a receiving cavity extending rearwardly thereinto, a comb passage communicating with the receiving cavity, two ramps raised from a bottom portion of the receiving cavity and extending in a front-to-rear direction, and a slot defined between the ramps; and a conductive contact received in the housing, the contact including a base portion having a front nose in a front portion thereof, a contacting portion angled rearwardly from the front nose and a shoulder extending transversely from a side of the base portion adjacent to the front nose, the base portion being held in the slot, the contacting portion being exposed in the receiving cavity, the contacting portion being deflected by the passage of the housing to engage the shoulder with the raised ramps;

wherein the passage deflects the contacting portion to provide a downward force on the contact;

wherein the housing includes two barriers projecting inwardly from the mating face into the receiving cavity, the ramps essentially aligned with and spaced from corresponding barriers in a front-to-rear direction, the slot extending between the barriers;

wherein the contact further includes a transition bight and a tail portion integrally attached to the base portion by a transition bight;

wherein the housing has a groove far from the front mating face, and wherein the tail portion of the contact includes a positioner portion received in the groove;

wherein the base portion further has an enlarged section far from the front nose, the enlarged section extending transversely and outwardly, the transition bight integrally extending from the enlarged section and interconnected between the base portion and the tail portion;

further including an insert module having a pinout therein, and wherein the contact extends into the pinout and electrically connects with the insert module;

further including a plastic rear cover attached to the housing with the insert module sandwiched therebetween;

wherein the plastic rear cover has a projection extending from a top end thereof, and wherein the housing defines a locking hole for receiving the projection;

wherein the plastic rear cover has a fixing portion, and wherein the housing includes a shaft projecting inwardly from a bottom portion thereof engaging with the fixing portion of the rear cover;

further including an outer shell affixed around the housing for electro Magnetic Interference (EMI) protection.

2. An electrical connector comprising:

an insulative housing having a front mating face providing a receiving cavity extending rearwardly thereinto, a bottom face located under the receiving cavity and with therein slots extending in a front-to-rear direction; and at least two spaced conductive contacts received in the housing, each of said contacts including a base portion extending along the front-to-rear direction on said bottom face and held in the corresponding slot, a contacting portion extending from a front end of the base portion and extending into the receiving cavity, a transition bight extending from a rear end of the base portion, and a tail portion extending rearwardly from the transition bight and structurally located at different level with regard to the base portion; wherein a pitch of the contacting portions of said two spaced contacts is smaller than that of the tail portions thereof;

wherein said tail portion includes a large positioning section to interferentially retain the contact in the housing;

wherein the tail portion is mechanically and electrically connected to an internal printed circuit board;

wherein said internal printed circuit board is connected to the tail portion in a perpendicular manner.

* * * * *